United States Patent [19]

Haug et al.

[11] Patent Number: 4,560,303

[45] Date of Patent: Dec. 24, 1985

[54] APPARATUS FOR FORMING CROSS COUNTRY SKIING TRACKS IN A SNOW COVERED SURFACE

[75] Inventors: Walter Haug, Blaustein, Fed. Rep. of Germany; Hans D. Zambelli, Salzburg, Austria

[73] Assignee: Karl Kassbohrer Fahrzeugwerke BmbH, Ulm, Fed. Rep. of Germany

[21] Appl. No.: 562,427

[22] Filed: Dec. 16, 1983

[30] Foreign Application Priority Data

Dec. 24, 1982 [DE] Fed. Rep. of Germany ..... 3247971

[51] Int. Cl.[4] ..... E01C 19/22

[52] U.S. Cl. ..... 404/118; 37/219

[58] Field of Search ..... 37/219, 220, 221; 180/180; 404/118

[56] References Cited

U.S. PATENT DOCUMENTS

| | | | |
|---|---|---|---|
| 1,005,689 | 10/1911 | Burr | 37/220 |
| 3,685,404 | 7/1970 | Rich et al. | 404/118 |
| 3,795,069 | 3/1974 | Cheney | 404/118 |
| 4,014,116 | 3/1977 | Baechler | 37/221 |
| 4,271,619 | 6/1981 | Mellingen | 37/219 |

FOREIGN PATENT DOCUMENTS

| | | | |
|---|---|---|---|
| 3025312 | 2/1981 | Fed. Rep. of Germany | 37/219 |
| 591877 | 9/1977 | Switzerland | 37/219 |
| 2039572 | 8/1980 | United Kingdom | 37/219 |

*Primary Examiner*—Stephen J. Novosad
*Assistant Examiner*—William P. Neuder
*Attorney, Agent, or Firm*—Maurice E. Gauthier

[57] ABSTRACT

An apparatus for forming cross country skiing tracks in a snow covered surface. The apparatus is adapted to be towed behind a vehicle and includes a trailer frame connected to the vehicle in a manner permitting the frame to pivot at least in the horizontal plane. A blade and a ski track device are carried by the frame. The blade is adapted to contact and recondition the snow covered surface, and the ski track device is adapted to form skiing tracks in the thus reconditioned snow covered surface. The blade and the ski track device are each fixed against pivotal movement relative to the frame in the horizontal plane. Thus, the trailer frame, the blade and the ski track device pivot in the horizontal plane as a unit relative to the vehicle.

3 Claims, 3 Drawing Figures

APPARATUS FOR FORMING CROSS COUNTRY SKIING TRACKS IN A SNOW COVERED SURFACE

BACKGROUND OF THE INVENTION

1. Field of the Invention

This invention relates to an apparatus which is adapted to be towed behind a vehicle and which operates to form cross country skiing tracks in a snow covered surface.

2. Description of the Prior Art

In the conventional apparatus of the above-mentioned type, a trailer frame is connected to the vehicle in a manner which prevents the frame from pivoting in a horizontal plane. The frame carries a blade and a ski track device. The blade also is fixed against movement relative to the frame in a horizontal plane, whereas the ski track device is connected in a manner which allows it to pivot freely in a horizontal plane. In order to make it possible for the ski track device to adapt to the terrain and to compensate for the steering movements of the vehicle, the ski track device is positioned at a considerable distance behind the blade. A control mechanism is connected between the frame and the vehicle. The control mechanism operates to vertically pivot the frame between a lowered operative position at which the blade and ski track device are in contact with the snow covered surface, and a raised inoperative position at which the blade and ski track device are clear of the snow covered surface. This type of apparatus has proved itself in practice. However, it has turned out that it would be beneficial to improve on the ability of the apparatus to follow the steering motion of the vehicle from which it is being towed.

SUMMARY OF THE PRESENT INVENTION

The present invention solves this problem by significantly shortening the distance between the ski track device and the blade, and by connecting the ski track device to the blade in a manner which permits the ski track device to pivot vertically while preventing the ski track device from pivoting horizontally. This results in a more compact unit, the components of which are fixed against horizontal pivotal movement relative to each other, with the result that the unit pivots horizontally as a whole relative to the vehicle.

The compact structural design of the apparatus provides several advantages. In the case of narrow curved paths, the ski track device is prevented from running outside of the path prepared by the blade. Furthermore, the center of gravity of the unit is positioned more closely to the rear of the vehicle, thereby facilitating lifting and lowering of the unit while minimizing stresses imposed on the vehicle chassis and the components employed to connect the apparatus to the vehicle.

The apparatus of the present invention also contributes to improved steering and controlability of the vehicle due to the fact that the entire unit, including the frame, blade and ski track device pivot horizontally as a wait about a single vertical axis relative to the vehicle as the vehicle is steered around curves. With this arrangement, the blade is not forcibly pushed around a curve and thus vehicle steering is enhanced.

Preferably, the frame is pivotally raised and lowered by means of a pair of extensible control mechanisms located on opposite sides of the point of connection of the frame to the vehicle. Preferably, these control mechanisms are arranged in a generally V, or U, or trapezoidal configuration, with the distance between the points of connection of the control mechanisms to the vehicle being greater than the distance between the points of connection of the control mechanisms to the frame.

With the above-described arrangement of the control mechanisms, pivotal lifting of the trailer frame produces an automatic centering of the frame and the components carried thereon. After lifting, the frame and its components are carried in a more stabilized fashion.

Preferably, the control mechanisms are located in a plane which is arranged at an angle of less than about 20° in relation to the vertical. This further shortens the overall length of the apparatus. Also, this steep arrangement of the control mechanisms makes it possible to vertically elevate the apparatus to a point at which it is quite close to the center of gravity of the vehicle, which relieves stresses imposed on the rear vehicle axle while also improving overall stability. Preferably, the blade is arranged to pivot vertically relative to the trailer frame about one horizontal axis, and the ski track device is connected to the blade for vertical pivotal movement about another parallel horizontal axis.

If the control mechanisms are operated with different pressures, they may be employed to direct the trailer frame and the components mounted thereon relative to the vehicle.

BRIEF DESCRIPTION OF THE DRAWINGS

A preferred embodiment of the invention will now be described with reference to the accompanying drawings, wherein.

DETAILED DESCRIPTION OF PREFERRED EMBODIMENT

Figure 1:
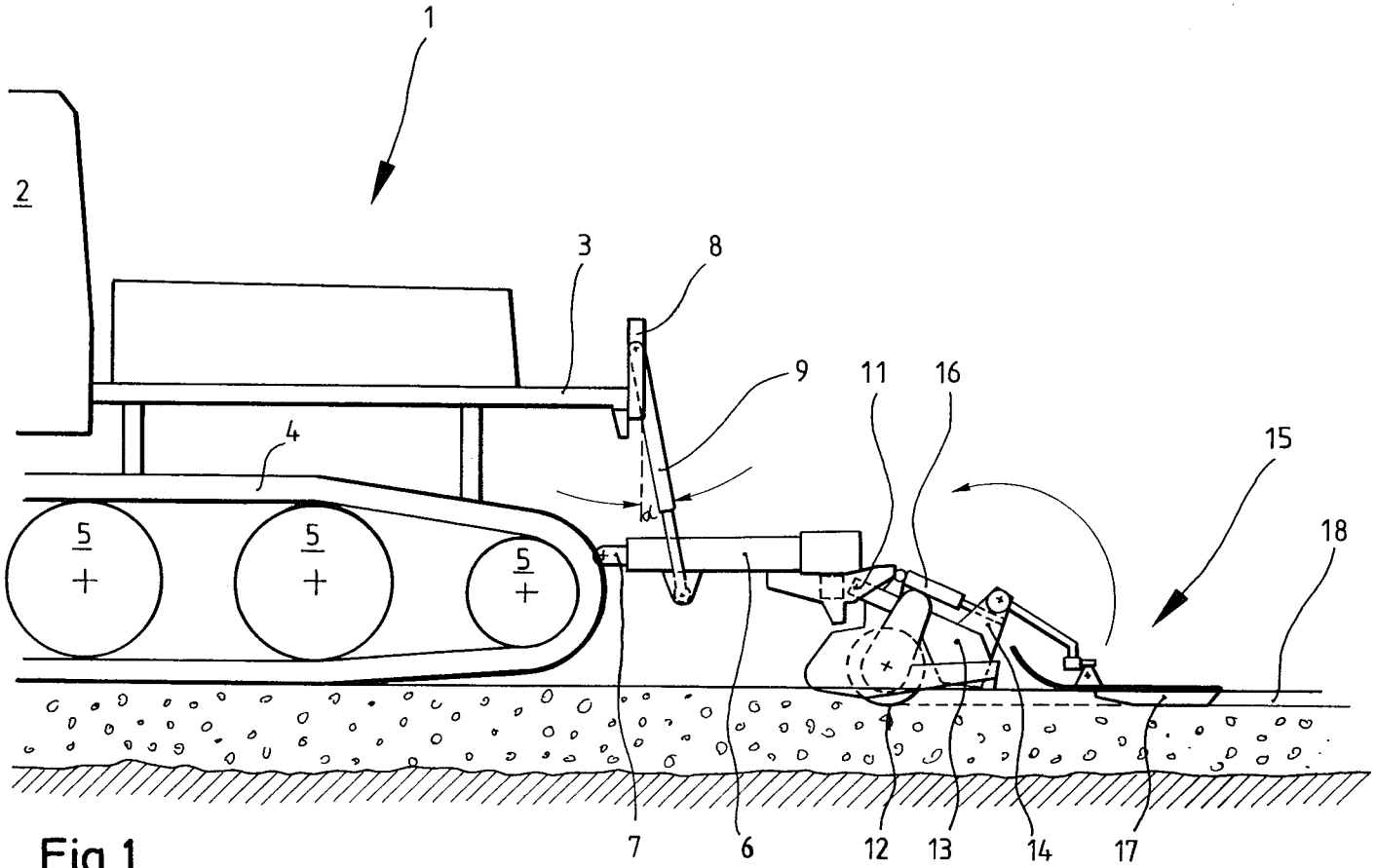
FIG. 1 is a side elevational view of a snow vehicle having an apparatus in accordance with the present invention operatively connected thereto.

Referring initially to FIG. 1, a snow track vehicle 1 of the conventional type is shown having a driver's cabin 2 and an equipment support deck 3 overlying caterpillar tracks 4 which run over track wheels 5.

The apparatus of the present invention includes a trailer frame 6 which extends rearwardly from and which is pivotally connected to the rear of the vehicle by means of a universal-type coupling 7 which accommodates both horizontal and vertical pivotal motion of the trailer frame which respect to the vehicle.

The deck 3 has vertical posts 8 which are positioned on either side of the longitudinal central axis L of the vehicle. The posts 8 support two control mechanisms 9 which typically can comprise extensible units such as piston-cylinder assemblies. Each control mechanism 9 is connected at one end to a post 8 and at the opposite end to a bracket fixed to a tubular component of the trailer frame 6. As can be best seen in FIG. 2, the distance between the points of connection of the control mechanisms to the posts 8 is greater than the distance between the points of connection of the control mechanisms to the trailer frame 6. Thus, the control mechanisms assume a somewhat trapezoidal configuration opening upwardly.

Figure 3:
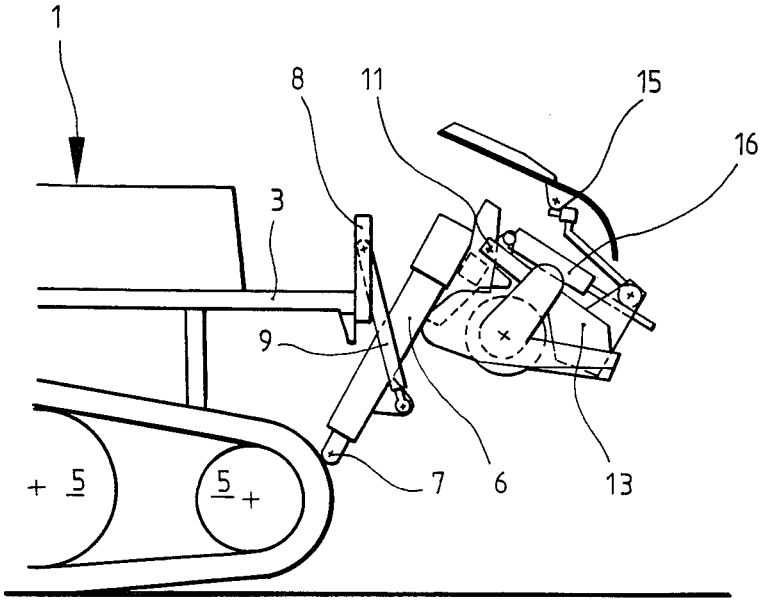
FIG. 3 is a partial side view similar to FIG. 1 showing the trailer frame and the components carried thereon elevated to an inoperative position.

As can be best seen in FIGS. 1 and 3, the control mechanisms 9 point sharply downwardly from the rear of the vehicle. Preferably, the control mechanisms form an angle d of less than about 20° with respect to the vertical posts 8. In the embodiment illustrated in the drawings, the angle d is approximately 12°.

With the above-described arrangement of the control mechanisms 9, horizontal lateral pivoting of the trailer frame 6 with respect to the vehicle 1 can be fully accommodated.

The trailer frame 6 is provided at its rear end with a laterally extending load distributor 10 which has an overall width approximately ⅔ that of the total width of the vehicle.

A conventional blade 12 has arms 13 connected to brackets on the underside of the load distributor 10 for vertical pivotal motion about a horizontal axis 11. The arms 13 have posts 14 thereon extending diagonally upwardly and to the rear away from the load distributor 10. A ski track device 15 is connected to each of the posts 14 for vertical pivotal movement about a horizontal axis which is located to the rear of and parallel to the axis 11. Both the blade 12 and the ski track device 15 are prevented, however, from pivoting horizontally relative to the trailer frame 6.

It will be seen from FIG. 1 that each ski track device 15 is arranged closely behind the blade 12. Each ski track device can be pivoted vertically about its horizontal axis relative to the blade 12 by means of a control device 16 which is connected to the blade assembly at one end and through a lever arm (not shown) to the ski track device 15 at the other end. The control mechanisms 16 can be used to press the ski track devices down onto the snow covered surface, and also to pivotally raise the ski track devices to their inoperative folded positions as shown in FIG. 3.

When the apparatus is in its operative position as shown in FIG. 1, the trailer frame 6 is in a nearly horizontal disposition. The snow blade 12 prepares and reconditions the snow covered surface. If the control mechanisms 9 are merely extended but not pressurized, the snow blade 12 is pressed into the snow surface by the weight of the unit. However, if this does not suffice, the control mechanisms 9 can be pressurized to force the trailer frame 6 and the blade 12 down towards the snow covered surface.

Figure 2:
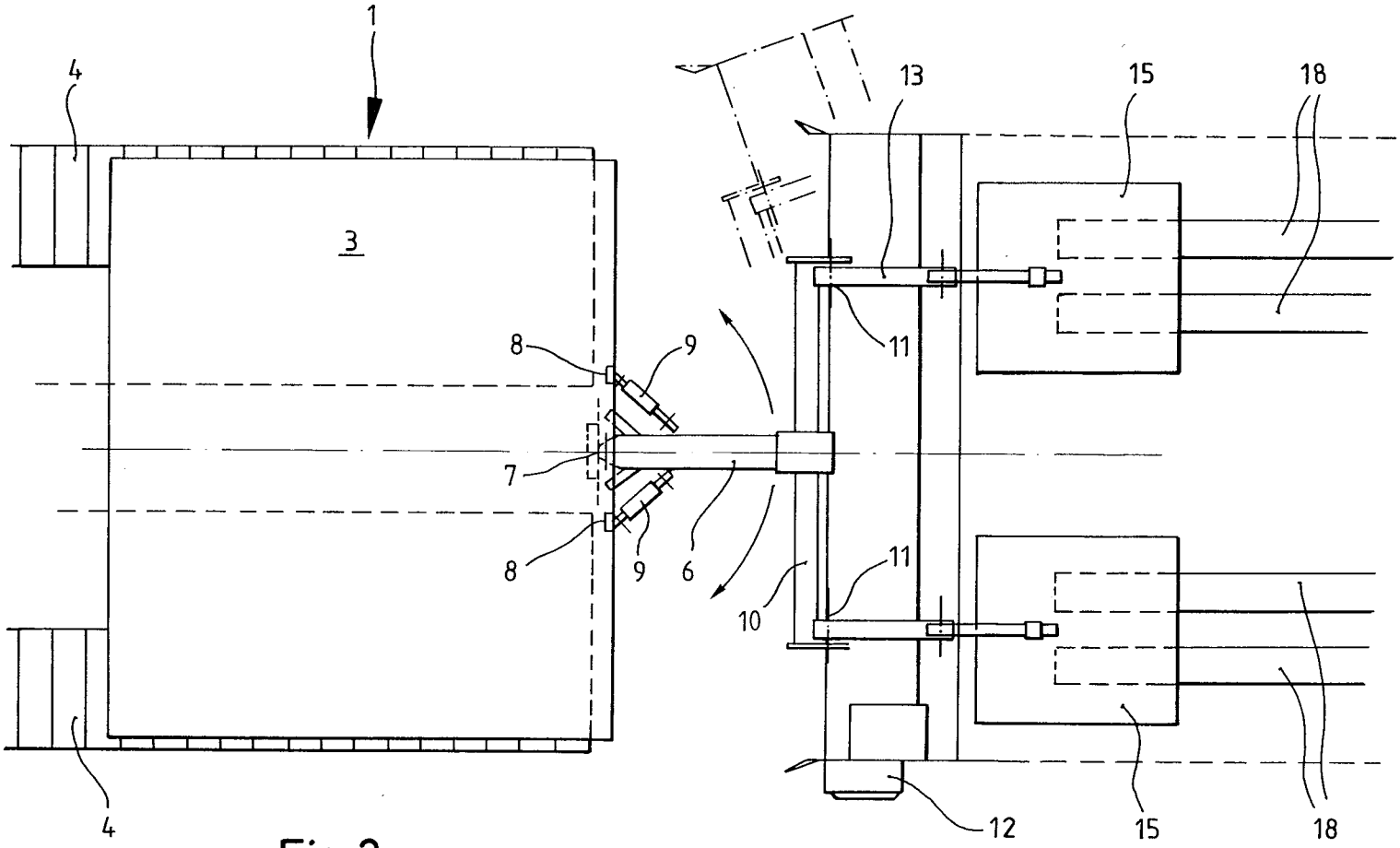
FIG. 2 is a top plan view of the vehicle and apparatus shown in FIG. 1.

The ski track devices 15 follow closely behind the blade 12 and impress the tracks 18 into the snow, as shown for example in FIG. 2. The control mechanism 16 also can be employed to force the ski track devices downwardly to increase the depth of the tracks 18.

The control mechanisms 9 can be employed to lift the trailer frame and the components supported thereon to a raised inoperative position as shown in FIG. 3. At this position, the trailer frame 6 is angled sharply upwardly and to the rear, with the blade assembly 12 having swung downwardly about the axis 11, and with the ski track devices 15 having been pivoted by means of the control devices 16 to folded positions overlying the blade assembly 12. It will thus be seen that the components have been pivoted relative to each other into an extremely compact assembly having a center of gravity which has been moved quite close to that of the vehicle 1, with a concomitant decrease in the stresses being imposed on the vehicle axles. As the assembly is lifted to the position shown in FIG. 3, the trapezoidal configuration of the control mechanisms 9 produces a self-centering action which further contributes to the overall stability of the unit.

In light of the foregoing, it will now be appreciated that the trailer frame 16, blade 12 and ski track devices 15 provide a compact unit which pivots as a unit horizontally at coupling 7 as the vehicle is steered around curved paths. The blade 12 is allowed to pivot vertically about axis 11 relative to the trailer frame 6, and the ski track devices 15 also are allowed to pivot vertically about relative to the blade 12, thereby enabling both the blade and ski track devices to accommodate undulations in the terrain.

Preferably, the tubular support of the trailer frame 6 is rotatable about its longitudinal axis to further accommodate such terrain irregularities.

We claim:

1. Apparatus for forming cross country skiing tracks in a snow covered surface, said apparatus being adapted to be towed behind a vehicle and comprising in combination:

a trailer frame;

universal coupling means for connecting said trailer frame to said vehicle, said universal coupling means being of a type which permits said frame to pivot relative to the vehicle in the horizontal plane about a vertical axis as well as in the vertical plane about a first horizontal axis;

a blade assembly mounted on said frame for pivotal movement solely in the vertical plane about a second horizontal axis located rearwardly of said first horizontal axis, said blade assembly being adapted to contact and recondition the snow covered surface;

a ski track device mounted on said blade assembly for pivotal movement solely in the vertical plane about a third horizontal axis located rearwardly of said second horizontal axis, said ski track device being adapted to form skiing tracks in the snow covered surface reconditioned by said blade assembly;

first operating means for pivotally adjusting said frame about said first horizontal axis between a substantially horizontal position at which said blade assembly and said ski track device are fully extended rearwardly and operatively positioned in contact with the snow covered surface, and an upwardly inclined position at which the combination of said blade assembly and said ski track device is pivoted forwardly about said second horizontal axis and elevated above the snow covered surface; and second operating means for pivotally adjusting said ski track device about said third horizontal axis between its operative position and a stowed position above said blade assembly.

2. The apparatus of claim 1 wherein said control means comprise a pair of extensible mechanisms connected to said vehicle and said frame on opposite sides of the point of connection of the frame to the vehicle, and with the distance between the points of connection of said mechanisms to said vehicle being greater than the distance between the points of connection of said mechanisms to said frame.

3. The apparatus of claim 2 wherein said extensible mechanisms are arranged in a plane forming an angle of less than about 20° with the vertical.

* * * * *